US009615609B2

(12) United States Patent
Grobler

(10) Patent No.: US 9,615,609 B2
(45) Date of Patent: Apr. 11, 2017

(54) NURSING BRA

(75) Inventor: Dean Grobler, Herning (DK)

(73) Assignee: CARRIWELL APS, Herning (DK)

( * ) Notice: Subject to any disclaimer, the term of this patent is extended or adjusted under 35 U.S.C. 154(b) by 101 days.

(21) Appl. No.: 14/417,455

(22) PCT Filed: Jul. 25, 2012

(86) PCT No.: PCT/DK2012/050279
§ 371 (c)(1),
(2), (4) Date: Jan. 26, 2015

(87) PCT Pub. No.: WO2014/015873
PCT Pub. Date: Jan. 30, 2014

(65) Prior Publication Data
US 2015/0196065 A1 Jul. 16, 2015

(51) Int. Cl.
*A41C 3/12* (2006.01)
*A41C 3/04* (2006.01)
*A41C 3/00* (2006.01)

(52) U.S. Cl.
CPC ..... *A41C 3/04* (2013.01); *A41C 3/12* (2013.01); *A41C 3/0007* (2013.01); *A41C 3/128* (2013.01)

(58) Field of Classification Search
CPC .... A41C 3/00; A41C 3/12; A41C 3/14; A41C 3/16; A41C 3/18; A41C 3/20; A41C 3/12; A41C 3/124; A41C 3/126; A41C 3/128
USPC ..... 450/41–53
See application file for complete search history.

(56) References Cited

U.S. PATENT DOCUMENTS 5,697,830 A 12/1997 White
6,319,092 B1 11/2001 Leyhe et al.
2003/0134569 A1* 7/2003 Falla ..... A41C 3/122 450/41
2004/0192165 A1* 9/2004 Falla ..... A41C 3/122 450/41
2005/0130559 A1* 6/2005 Falla ..... C22C 38/06 450/54
2005/0164602 A1 7/2005 Armstrong et al.
(Continued)

FOREIGN PATENT DOCUMENTS

CN 201 204 939 Y 3/2009
DE 202 10 023 U1 8/2002
WO 2009/137223 A2 11/2009

OTHER PUBLICATIONS

International Search Report, dated Feb. 22, 2013, from corresponding PCT application.

*Primary Examiner* — Gloria Hale
(74) *Attorney, Agent, or Firm* — Young & Thompson

(57) ABSTRACT

A nursing bra includes a front portion including a first cup and a second cup; a back portion, wherein the front and back portions are connected at the sides of the bra. The nursing bra further includes a first shoulder strap extending from the back portion to the first cup and a second shoulder strap extending from the back portion to the second cup, wherein the straps are permanently connected to the front portion through connection parts and the straps are releaseably connected to the cups through cup release elements. The front portion includes a first flexible tube and a second flexible tube each including filler in the form of a liquid or a semi-liquid, wherein the first tube extends along at least part of the underside edge of the first cup and the second tube extends along at least part of the underside edge of the second cup.

16 Claims, 3 Drawing Sheets

(56) References Cited

U.S. PATENT DOCUMENTS

Figure 1:
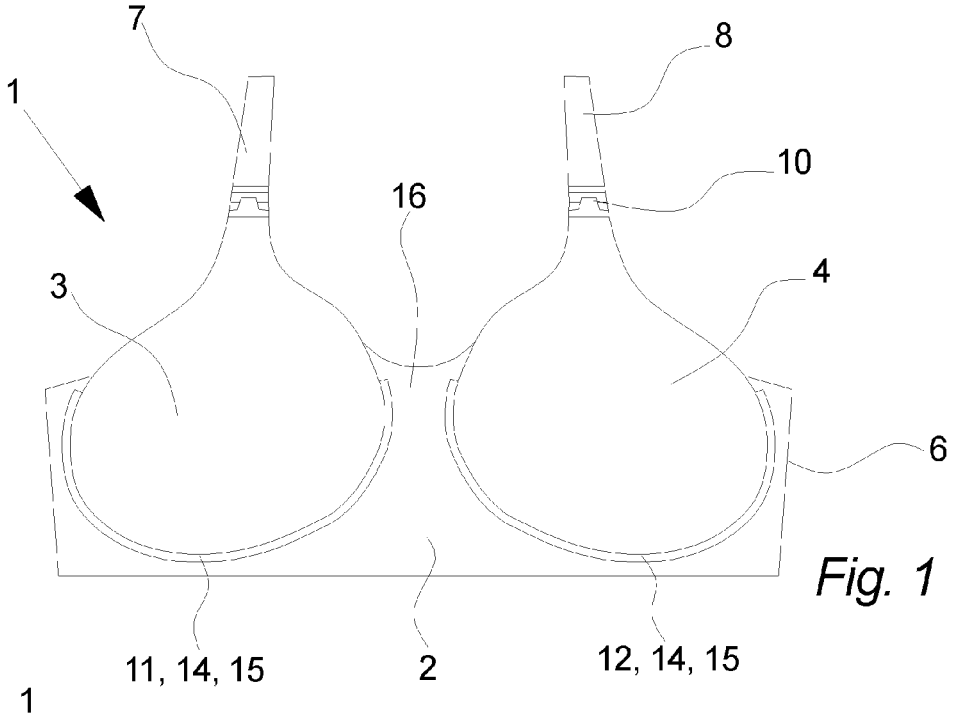

| | | | | |
|---|---|---|---|---|
| 2010/0068971 | A1 | 3/2010 | Hendrickson | |
| 2011/0237156 | A1 | 9/2011 | Boonen et al. | |
| 2014/0045408 | A1* | 2/2014 | Yung | A41C 3/122 450/41 |
| 2015/0004874 | A1* | 1/2015 | Zhang | A41C 3/122 450/41 |
| 2015/0004875 | A1* | 1/2015 | Zhang | A41C 3/122 450/52 |
| 2015/0370784 | A1* | 12/2015 | Nissan | G06F 17/2809 704/2 |

* cited by examiner

NURSING BRA

FIELD OF THE INVENTION

The invention relates to a nursing bra comprising a front portion including a first cup and a second cup and a back portion. The front portion and the back portion are connected at the sides of the nursing bra. A first shoulder strap is extending from the back portion to the first cup and a second shoulder strap is extending from the back portion to the second cup.

BACKGROUND OF THE INVENTION

Nursing bras are designed to provide easy access to one breast at a time during breast feeding of a child. This access is usually provided by enabling that at least a part of each bra cup can easily be lowered during feeding where after the bra cup can be returned and fixed in its normal position. To ensure that the cups can be easily lowered and raised to provide the necessary comfort for the wearer it is advantageous that the shape of the bra is relatively fixed.

Dedicated support structures such as metal wires along the edge at the underside of the cups are commonly used in relation to non-nursing bras to help maintaining the shape of the bra and particularly the shape of the cups and from U.S. Pat. No. 5,697,830 and U.S. Pat. No. 6,319,092 it is known to use such underwires in relation to nursing bras to provide support to the breasts and to help maintain the bras shape. However, the use of underwires has not been successful in the area of nursing bras because it is difficult to incorporate this without compromising the complex functionality and flexibility of the nursing bra.

An object of the invention is therefore to provide for a comfortable nursing bra which is easy to use.

THE INVENTION

The invention provides for a nursing bra comprising a front portion including a first cup and a second cup. The bra also comprises a back portion, wherein the front portion and the back portion are connected at the sides of the nursing bra. The nursing bra further comprises a first shoulder strap extending from the back portion to the first cup and a second shoulder strap extending from the back portion to the second cup, wherein the straps are permanently connected to the front portion through connection parts and wherein the straps are releaseably connected to the cups through cup release means. The front portion comprises a first flexible tube and a second flexible tube each including filler in the form of a liquid or a semi-liquid, wherein the first tube extends along at least a part of the underside edge of the first cup and wherein the second tube extends along at least a part of the underside edge of the second cup.

Providing a nursing bra with flexible tubes—containing a liquid or a semi-liquid—along at least a part of the under edge of the cups will make the bra more dimensionally stable and at the same time provide support to the wearer, hereby ensuring that the bra substantially maintains its shape and position while the bra is worn, both in closed condition and when the cups are lowered and during nursing and thereby ensures that the bra can easily be closed afterwards. And due to the flexible quality of the tubes these advantages are obtained without hindering that a cup may easily be folded down and provide sufficient and unhindered access to the breast during breast feeding of a child.

Even further, the flexible property of the flexible tubes also ensures that the tubes substantially does not apply too high pressure to the often sore and tender tissue of a milk producing breast, hereby increasing the comfort of the wearer and reducing the risk of mastitis due to blocked milk ducts.

By the term "flexible tube" is to be understood any kind of pipe, duct, channel, hose or similar elongated container means which are flexible and bendable so that they are capable of following the sometimes complex contour of the female anatomy and in particular the shape around the edge of a female breast.

Also, by the term "semi-liquid" is to be understood any kind of liquid having properties, especially flow properties, intermediate between those of a solid and a liquid.

In an aspect of the invention, said front portion and said back portion are formed substantially from the same fabric blank.

Forming the front portion and the back portion from the same fabric blank is advantageous in that it provides for a more simple and inexpensive manufacturing process.

In an aspect of the invention, said nursing bra is produced from a piece of circularly knitted fabric.

Forming the nursing bra from a piece of circularly knitted fabric is advantageous in that it enables a simple and inexpensive manufacturing process and it enables that the bra may be formed without bra locking means at the back.

Forming the nursing bra substantially from one fabric blank, produces what is in the industry referred to as a "seamless bra". The term seamless does not mean that the finished and ready-to-wear bra is completely without seems. The term means that the fabric blank a seamless bra is made from, is knitted seamlessly—normally on a circular knitting machine but it could also be done on a flat-knitting machine—so that a bra can be sewn from a blank with a limited number of seams, and from a limited number of parts and still comprise the necessary 3D-shapes, required to support the female anatomy. So generally it is not the make-up process that is seamless in that bras will always require some seams or other connections/edge-finishing like welding, trims etc.

Reducing the number of seems in the bra is particularly advantageous in relation with nursing bras in that seams can rub against or irritate the expanded and sore breast tissue and in that the seams can locally make the bra less flexible and/or elastically hereby potentially increase the discomfort of the wearer.

In an aspect of the invention, said nursing bra is produced from a 3D-shaped fabric blank.

It is advantageous to make the bra from a 3D-shaped fabric blank in that it enables the bra can be given the desired three dimensional (3D) shape during the knitting process hereby further reducing the number of seams of the bra.

In an aspect of the invention, said flexible tubes are arranged in a transition zone between said cups and the adjoining material.

Placing the tubes along the edge of the cup in the transition zone between the cup and the adjoining front portion material is advantageous in that the tube hereby will provide better support to the breast and at the same time help maintaining the shape of the bra during nursing and normal wear.

In an aspect of the invention, said flexible tubes extends substantially the entire length of said transition zone between said cups and the adjoining material.

Making the tubes extend substantially the entire length of the edge between the cup and the rest of the front portion is advantageous in that the tube will hereby provide better support and ensure that the cup fits better all the way along the edge.

In an aspect of the invention, said filler is semi-liquid silicone.

Using a silicone gel as filler in the flexible tube is advantageous in that silicone is a poor heat conductor making it feel temperature neutral and thereby comfortable next to the skin of the wearer. Furthermore, a silicone gel has a viscosity that ensures that the tube does not become either too hard or too flexible.

Furthermore, silicone is non-toxic, durable, stable and chemically inactive substance ensuring no harm to the wearer or a child if the tube should leak.

In an aspect of the invention, said flexible tubes are substantially completely filled with said liquid or said semi-liquid.

If the tube is at least partly filled with air the tube can be locally compressed and thereby locally buckled hereby increasing the risk of the tube pressing or rubbing against the skin of the wearer and thereby produce discomfort.

In an aspect of the invention, said flexible tubes are formed in a non-elastic material.

If the tube is formed in a non-elastic material the tube will ensure that the shape of the cup is maintained along the edge of the cup even if the cup or the bra is stressed or even deformed during the opening or closing of the bra cup or during nursing. This is particularly important with so-called seamless bras which are usually made from a more elastic fabric to ensure a snug fit even if it is not made to the exact shape of the wearer.

In an aspect of the invention, said flexible tubes are made from plastic.

A tube can relatively easy be formed in a complex shape when it is made from plastic and since plastic is a flexible, tight and relatively inexpensive material it is particularly suited for making flexible tubes for nursing bras.

In an aspect of the invention, said flexible tubes are connected to said front portion by means of stitching.

Connecting the flexible tube to the bra by means of stitching is advantageous in that stitching is a proven method of attachment within the bra manufacturing industry and in that stitching will ensure a solid and durable hold of the tube substantially without reducing its flexibility.

In an aspect of the invention, said back portion is divided by bra locking means.

Particularly in relation with nursing bras it is advantageous that the bra can easily be put on and taken off and it is therefore advantageous to provide a nursing bra with bra locking means at the back which enables that the bra can be opened at the back and easily be put on or taken off.

By the term "bra locking means" is to be understood any kind of hook-and-loop fastener, hook and eye closure, buttons or any other kind of locks suitable for ensuring that a nursing bra can be opened and closed by a user.

In an aspect of the invention, the viscous property of said filler is temperature dependent.

Making the viscous property of the filler temperature dependent is advantageous in that the flexibility if the filled tube hereby will adjust to the surrounding temperature i.e. it could become softer during wear close to the skin and slightly more rigid away from the skin hereby increasing the support offered by the tube without increasing the risk of discomfort.

In an aspect of the invention, said first flexible tube and/or said second flexible tube further comprises solid element such as a metal wire or a plastic strip.

Providing the flexible tubes with a metal wire or a plastic strip is advantageous in that the wire or strip can help maintaining the shape of the flexible tubes and in than the strips or wires can be used to adjust the rigidity of the flexible tubes e.g. to provide better support.

In an aspect of the invention, said nursing bra further comprises cushioning means arranged between said flexible tubes and the wearer of said bra.

Providing cushioning means on the bra between the flexible tube and the wearer is advantageous in that it reduces the risk of the flexible tube causing discomfort to the wearer of the nursing bra.

FIGURES

Figure 2:
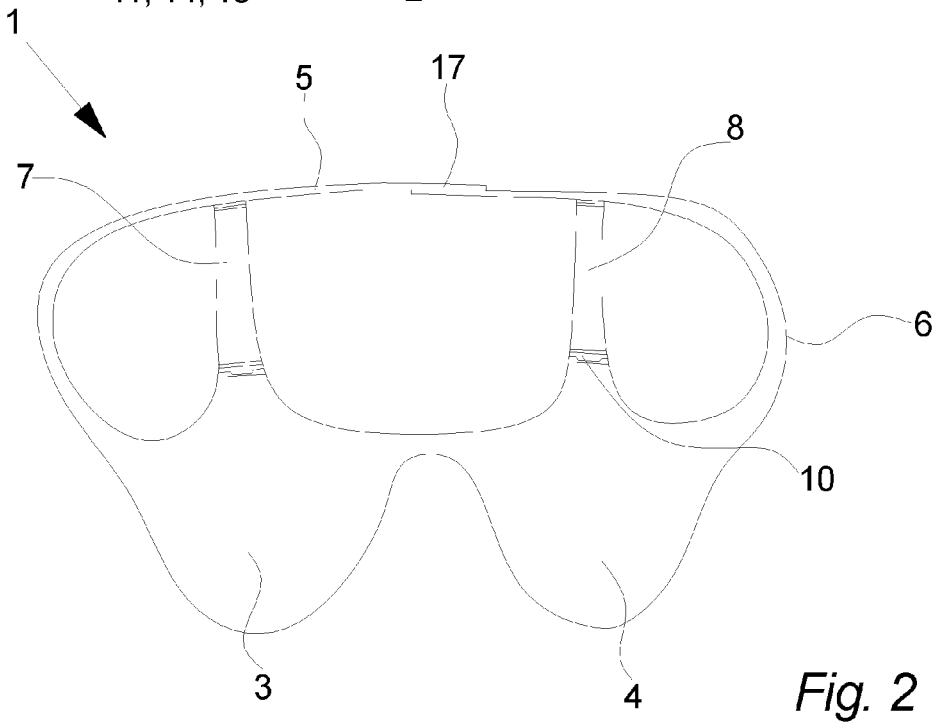
Figure 3:
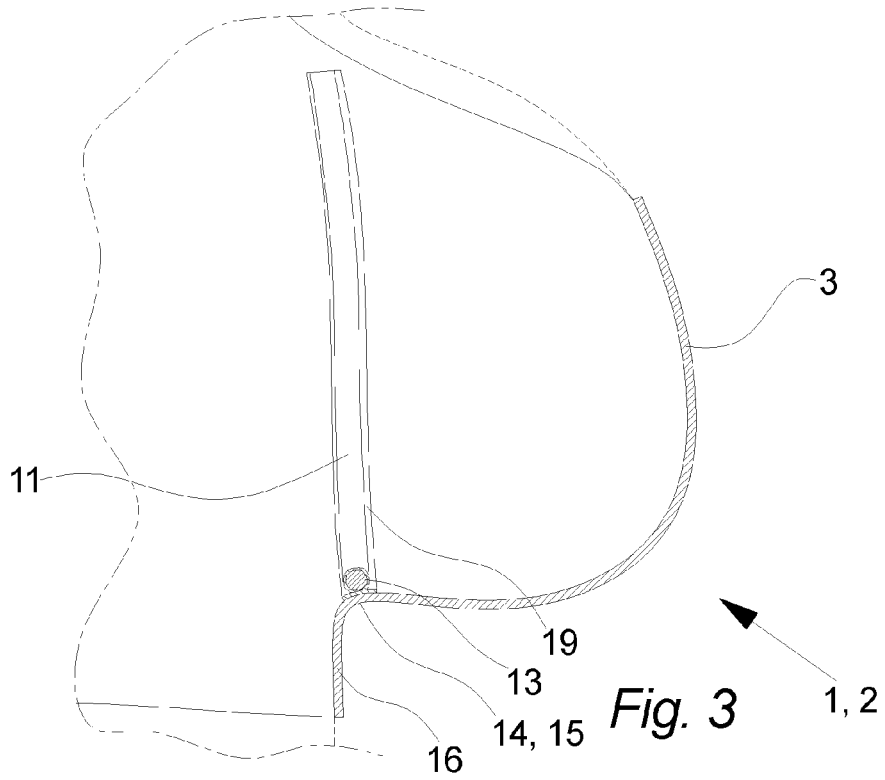
Figure 4:
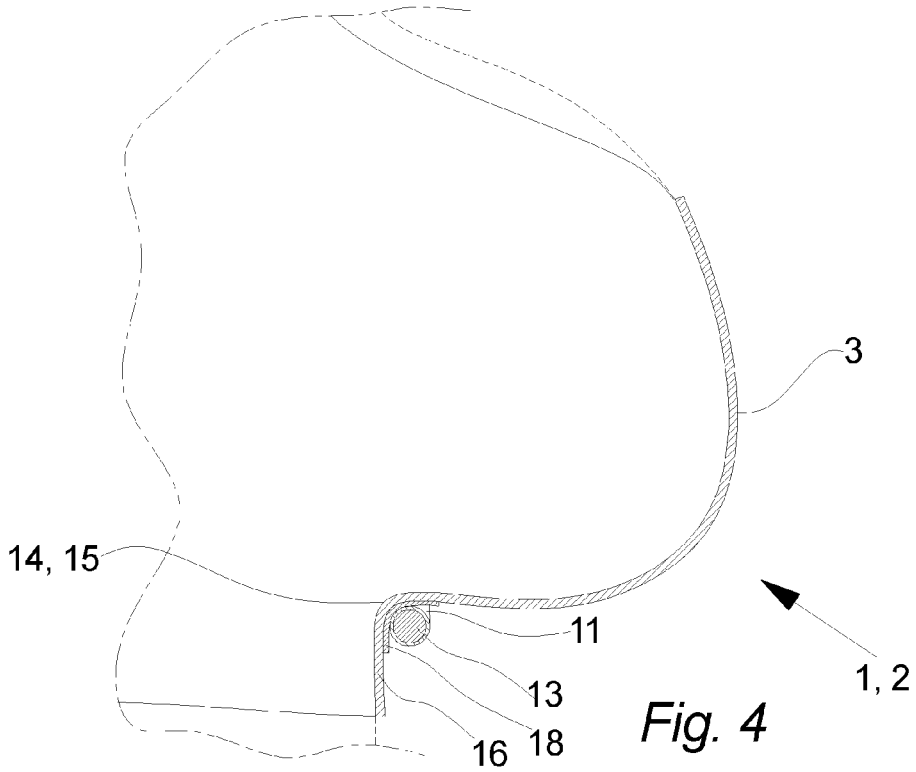
Figure 5:
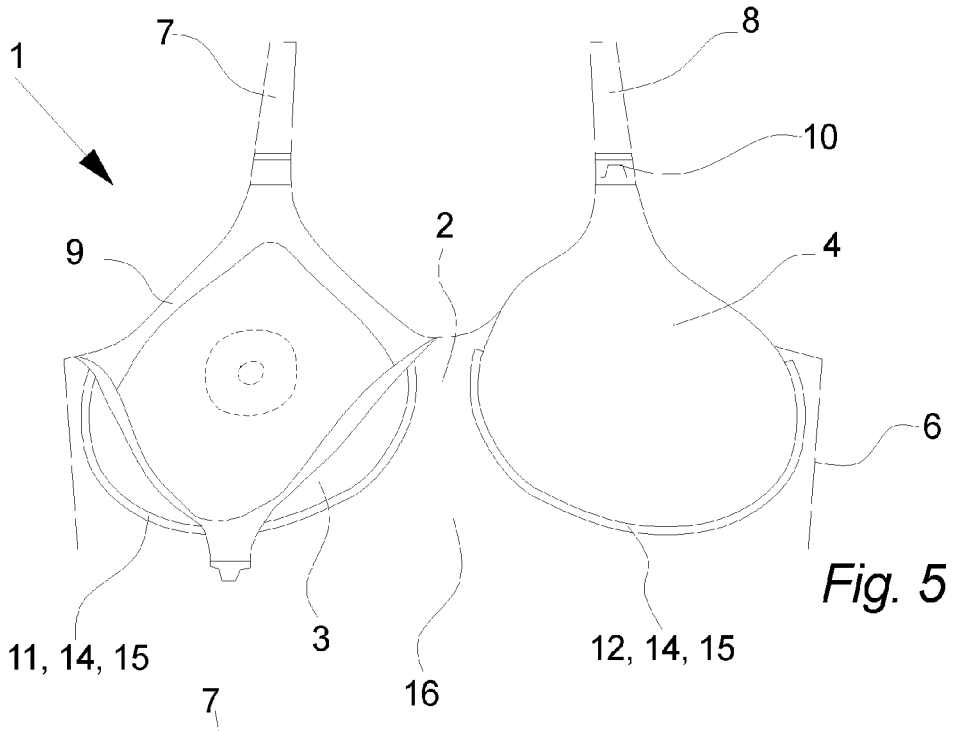
Figure 6:
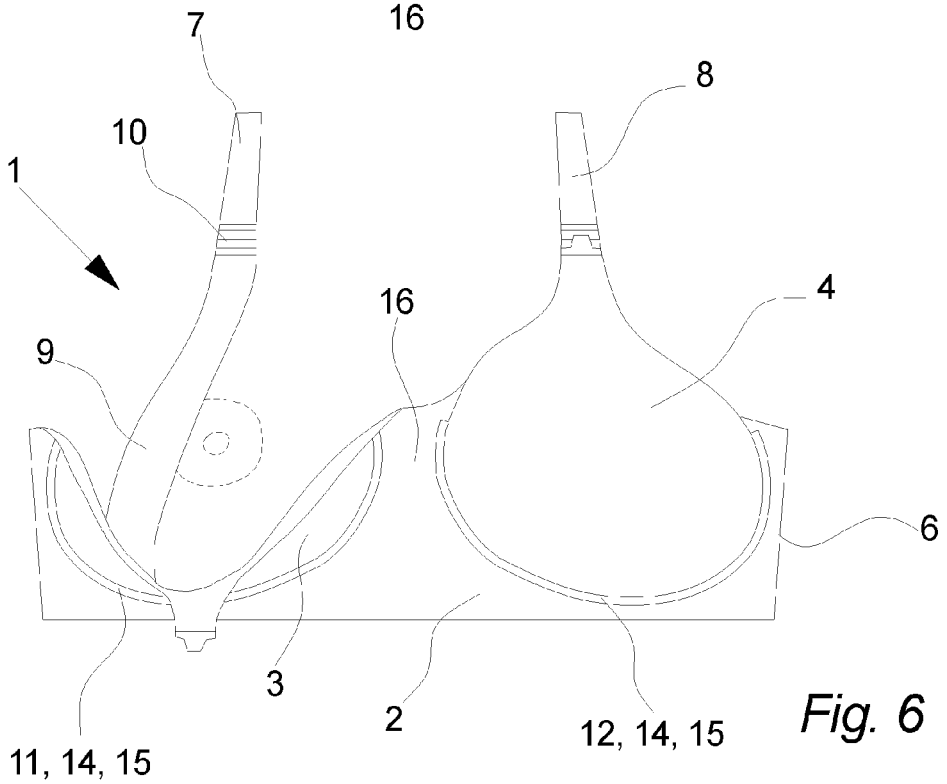

The invention will be described in the following with reference to the figures in which FIG. 1. illustrates a nursing bra according to the present invention, as seen from the front, FIG. 2 illustrates the nursing bra shown in FIG. 1, as seen from the top, FIG. 3 illustrates a cross section through a nursing bra comprising a flexible tube on the inside surface, as seen from the side, FIG. 4 illustrates a cross section through a nursing bra comprising a flexible tube on the outside surface, as seen from the side, FIG. 5. illustrates a double ply nursing bra with one cup in an open state, as seen from the front, and FIG. 6 illustrates a single ply nursing bra with one cup in an open state, as seen from the front.

DETAILED DESCRIPTION

FIG. 1 illustrates a nursing bra 1 according to the present invention, as seen from the front.

In this embodiment of the invention the nursing bra 1 is provided with a first flexible tube 11 extending along the underside edge 14 of a first cup 3 and a second flexible tube 12 extending along the underside edge 14 of a second cup 4. In this embodiment both tubes 11, 12 are arranged in the transition zone 15 between the cups 3, 4 and the adjoining material 16 of the front portion 2 of the bra. However, in another embodiment of the invention one or both tubes could be attached next to this transition zone 15 i.e. a bit further away from the cups 3, 4.

In this embodiment of the invention the flexible tubes 11, 12 are extending substantially the entire length of the transition zones 15 but in another embodiment one or both flexible tubes 11, 12 could be formed shorter i.e. they could e.g. only extend under the cup 3, 4 and up along one side.

In this embodiment of the invention the flexible tubes 11, 12 are each formed as one continuous tube 11, 12 but in another embodiment each of the tubes 11, 12 could be formed as several tube parts arranged end to end or even spaced apart e.g. to only provide support at particularly loaded areas.

In this embodiment of the invention only one tube 11, 12 is provided at each cup 3, 4 but in another embodiment of the invention each cup 3, 4 could be supported by two, three, four or more individual tubes 11, 12 e.g. having different shapes and/or sizes, to increase or reduce the support and/or the flexibility locally at some areas along the rim of the cups 3, 4.

FIG. 2 illustrates the nursing bra 1 shown in FIG. 1, as seen from the top.

In this embodiment of the invention the nursing bra 1 comprises a front portion 2 on which the first cup 3 and the second cup 4 are arranged. The front portion 2 is connected to a back portion 5 through the sides 6 of the bra 1 and in this embodiment of the invention the nursing bra 1 is formed seamlessly in that the front portion 2, including the cups 3, 4 are formed integrally with the sides 6 and the back portion from the same piece of circularly knitted fabric. The three dimensional shape of the bra 1 is provided during the knitting process and by forming the bra 1 in a stretchable material it is ensured, that the bra 1 is inherently adaptable to individual shapes, forms and to some degree also sizes of the torso and breasts of a wearer. However this adaptable quality also reduces the support provided by the nursing bra 1 and it increases the risk of the bra 1 getting out of place during normal wear and in particular in relation to its use as a nursing bra when the cups 3, 4 are released and lowered, which makes the stability and support in the cup areas 3,4 and front portion 2 of the bra less than in a normal bra. It is therefore particularly advantageous to provide a seamless nursing bra 1 with flexible tubes as illustrated on the other figures.

In this embodiment of the invention the nursing bra 1 is provided with a first shoulder strap 7 extending from the back portion 5 to the first cup 3 across a first shoulder (not shown) of a wearer and a second shoulder strap 8 extending from the back portion 5 to the second cup 4 across a second shoulder (not shown) of a wearer. In this embodiment the shoulder straps 7, 8 are not formed integrally with the rest of the bra 1 in that the straps 7, 8 are made from a dedicated elastic strap material and then attached at both the front and the back portion 2, 5 of the bra 1.

In this embodiment of the invention the back portion 5 is provided with bra locking means 17 enabling that the nursing bra 1 easily can be put on and taken of. However, in another embodiment of the invention the bra locking means 17 could be placed in one or both sides 6 of the bra 1 or in the front portion of the bra 1.

FIG. 3 illustrates a cross section through a nursing bra 2 comprising a flexible tube 11 on the inside surface, as seen from the side.

In this embodiment the nursing bra 1 is formed seamlessly in that the cup 3 and the adjoining material 16 is formed from the same fabric blank which has been knitted with a 3D shape. However, to improve the fit of particularly the cup 3 and to increase the support, the nursing bra 1 has in this embodiment been provided with a flexible tube 11 running in the transition zone 15 between the cup 3 and the adjoining material 16 of the front portion 2 of the nursing bra 1.

In this embodiment of the invention the flexible tube 11 is formed as a bulge extending from a substantially flat base part 19. The flexible tube 11 is in this embodiment permanently connected at the transition zone 15 by means of stitching through the sides of the base part 19 extending beyond the bulge. However in another embodiment of the invention the flexible tubes 11, 12 could be permanently connected to the bra 1 by means of welding, by means of adhesive, by means of stapling or by other permanent attachment means or the flexible tubes 11, 12 could be removably incorporated in the bra 1 e.g. by insertion in a duct formed integrally with the bra 1 or in a duct attached to the bra 1.

In this embodiment of the invention the tube 11 is substantially completely filled with silicone gel but in another embodiment the filler 13 could be water, petroleum jelly, grease or another durable and non-toxic liquid or semi-liquid suitable for use as a filler 13 in a flexible tube 11, 12 for a nursing bra 1.

In this embodiment of the invention the tube 11 is made from a relatively thin plastic film ensuring that the filler 13 does not leak while at the same time ensuring the tube 11 is appropriately flexible. However, in another embodiment the tube 11 could be made from an injection moulded plastic, plastic coated textile or another material which is flexible and will ensure that the filler 13 does not leak.

In this embodiment of the invention the flexible tube 11 is attached to the inside surface of the bra 1, e.g. to provide a desirable outer design of the bra 1 but as shown in FIG. 4 the tube 11 could also be attached to the outside surface of the bra 1 e.g. for the bra fabric to cushion the tube 11 slightly on the inside against the wearers skin.

FIG. 4 illustrates a cross section through a nursing bra 1 comprising a flexible tube 11 on the outside surface, as seen from the side.

In this embodiment the tube 11 is formed as a cylinder attached to cushioning means 18 arranged between the tube 11 and the wearer to reduce the risk of the tube 11 adding to much pressure to the sensible breast tissue locally. The cushioning means 18 are in this embodiment attached to the bra 1 by means of adhesive.

In this embodiment the cross section of the tube 11 is formed substantially circular but in another embodiment the cross section could be oval, square, polygonal or another more or less complex shape.

In this embodiment of the invention the cross section of the tube 11 is substantially uniform throughout the entire extent of the tube 11 but in another embodiment the cross section could vary in size and/or shape e.g. to locally provide more support.

In this embodiment of the invention the flexible tube 11 only comprises a filler 13 in the form of a liquid or a semi-liquid but in another embodiment of the invention the flexible tube 11 could also comprise more solid elements such as a wire e.g. in the form of one or more coils or springs or the solid element could be in the form of a strip or a stick. Such a solid element could be made from metal such as aluminum, steel or stainless steel or it could be made of some sort of solid plastic material.

FIG. 5 illustrates a double ply nursing bra 1 with one cup 3 in an open state, as seen from the front.

In a nursing bra 1 according to the present invention the shoulder straps 7, 8 are permanently connected to the front portion 2 through connection parts 9 enabling that the shoulder strap 7, 8 does not retract back over the shoulder when one of the cups 3, 4 is lowered and the connection parts 9 ensures that the nursing bra 1 stays in place during nursing so that the cup 3 may easily be closed again afterwards.

In this embodiment of the invention the connection parts 9 are formed in a separate inner ply of the bra 1 where the cups 3, 4 are formed in the outer ply.

In this embodiment of the invention the cups 3, 4 are releaseably connected to the straps 7, 8 by means of cup release means 10 enabling that the cups 3, 4 may be released at the top and then flipped down to expose the breast and thereby provide access to the nipple of the breast so that a child may be fed. It is particularly important that the tubes 11, 12 are flexible in this situation, so that they do not hinder that the cups 3, 4 can easily be flipped down.

In this embodiment of the invention the cup release means 10 are a 2-part hook/eye device but in another embodiment the cup release means 10 could be formed as a hook-and-loop fastener, a hook and eye closure, buttons or similar releasable locking means.

FIG. 6 illustrates a single ply nursing bra 1 with one cup 3 in lowered state, as seen from the front.

In this embodiment the connection parts 9 are formed as a separate part connected in one end to the shoulder strap 7, 8 and in the other end to the adjoining material 16 of the front portion 2 of the nursing bra 1. Thus, in this embodiment the bra 1 is made substantially from a single fabric ply.

The invention has been exemplified above with reference to specific examples of nursing bras 1, connection parts 9, flexible tubes 11, 12 and other. However, it should be understood that the invention is not limited to the particular examples described above but may be designed and altered in a multitude of varieties within the scope of the invention as specified in the claims.

LIST

1. Nursing bra
2. Front portion
3. First cup
4. Second cup
5. Back portion
6. Side of nursing bra
7. First shoulder strap
8. Second shoulder strap
9. Connection part
10. Cup release means
11. First flexible tube
12. Second flexible tube
13. Filler
14. Underside edge
15. Transition zone
16. Adjoining material
17. Bra locking means
18. Cushioning means
19. Base part

The invention claimed is:

1. A nursing bra (1) comprising, a front portion (2) including a first cup (3) and a second cup (4), a back portion (5), wherein said front portion (2) and said back portion (5) are connected at the sides (6) of said nursing bra (1), a first shoulder strap (7) extending from said back portion (5) to said first cup (3), a second shoulder strap (8) extending from said back portion (5) to said second cup (4), wherein said straps (7, 8) are permanently connected to said front portion (2) through connection parts (9) and wherein said straps (7, 8) are releaseably connected to said cups (3, 4) through cup release means (10), and wherein said front portion (2) comprises a first flexible tube (11) and a second flexible tube (12) each including filler (13) in the form of a liquid or a semi-liquid, wherein said first tube (11) extends along at least a part of the underside edge (14) of said first cup (3) and wherein said second tube (12) extends along at least a part of the underside edge (14) of said second cup (4), the first and second flexible tubes and filler providing dimensional stability to said bra and support to a wearer of said bra.

2. A nursing bra (1) according to claim 1, wherein said front portion (2) and said back portion (5) are formed substantially from the same fabric blank.

3. A nursing bra (1) according to claim 1, wherein said nursing bra (1) is produced from a piece of circularly knitted fabric.

4. A nursing bra (1) according to claim 1, wherein said nursing bra (1) is produced from a 3D-shaped fabric blank.

5. A nursing bra (1) according to claim 1, wherein said flexible tubes (11, 12) are arranged in a transition zone (15) between said cups (3, 4) and the adjoining material (16).

6. A nursing bra (1) according to claim 5, wherein said flexible tubes (11, 12) extends substantially the entire length of said transition zone (15) between said cups (3, 4) and the adjoining material (16).

7. A nursing bra (1) according to claim 1, wherein said filler (13) is semi-liquid silicone.

8. A nursing bra (1) according to claim 1, wherein said flexible tubes (11, 12) are substantially completely filled with said liquid or said semi-liquid.

9. A nursing bra (1) according to claim 1, wherein said flexible tubes (11, 12) are formed in a non-elastic material.

10. A nursing bra (1) according to claim 1, wherein said flexible tubes (11, 12) are made from plastic.

11. A nursing bra (1) according to claim 1, wherein said flexible tubes (11, 12) are connected to said front portion (2) by means of stitching.

12. A nursing bra (1) according to claim 1, wherein said back portion (5) is divided by bra locking means (17).

13. A nursing bra (1) according to claim 1, wherein the viscous property of said filler (13) is temperature dependent.

14. A nursing bra (1) according to claim 1, wherein said first flexible tube (11) and/or second flexible tube (12) further comprises a solid element such as a metal wire or a plastic strip.

15. A nursing bra (1) according to claim 1, wherein said nursing bra (1) further comprises cushioning means (18) arranged between said flexible tubes (11, 12) and the wearer of said bra (1).

16. A nursing bra (1) according to claim 2, wherein said nursing bra (1) is produced from a piece of circularly knitted fabric.

* * * * *